United States Patent [19]

Grahn

[11] 4,226,194

[45] Oct. 7, 1980

[54] METHOD OF IDENTIFYING A THIEF AND STOLEN ARTICLES

[76] Inventor: Donald T. Grahn, 6551 - 45th Ave. N.E., Seattle, Wash. 98115

[21] Appl. No.: 11,092

[22] Filed: Feb. 12, 1979

[51] Int. Cl.[2] ..... G08B 15/02

[52] U.S. Cl. ..... 109/25; 135/29

[58] Field of Search ..... 109/25, 29–34

[56] References Cited

U.S. PATENT DOCUMENTS

| | | | |
|---|---|---|---|
| 1,606,258 | 11/1926 | Morssen | 109/25 |
| 2,041,577 | 5/1936 | Sutherland | 109/32 |
| 3,344,757 | 10/1967 | Touyet | 109/25 |
| 3,564,525 | 2/1971 | Robeson | 109/25 |
| 3,730,110 | 5/1973 | Peters | 109/25 |

FOREIGN PATENT DOCUMENTS

| | | | |
|---|---|---|---|
| 2203150 | 1/1972 | Fed. Rep. of Germany | 109/25 |
| 592,230 | 10/1977 | Switzerland | 109/25 |

*Primary Examiner*—Reinaldo P. Machado

*Attorney, Agent, or Firm*—Christensen, O'Connor, Johnson & Kindness

[57] ABSTRACT

A method of chemically labeling articles during the course of a theft or robbery and thereby subsequently detecting and identifying both the stolen articles and the thief thereof. A small amount of a latent color reagent having as an active ingredient ninhydrin or hydrindantin or a mixture thereof is discreetly dispensed onto articles in the event of their theft or robbery. Subsequent handling of the articles by the thief causes an indelible stain to form on the hands of the thief approximately twenty minutes after contacting the latent color reagent on the articles. The skin is indelibly stained for twelve to forty-eight hours and the thief is thereby rendered conspicuous. The stolen articles remain intimately contacted with the latent color reagent indefinitely and can be subsequently identified visually by application of a developing solution to produce a characteristic blue-purple stain on the articles.

13 Claims, No Drawings

METHOD OF IDENTIFYING A THIEF AND STOLEN ARTICLES

BACKGROUND OF THE INVENTION

This invention relates generally to crime prevention and detection methods and, more particularly, to a method for chemically labeling and thereby subsequently detecting and identifying stolen articles and the thief thereof by means of a latent color reagent containing as an active ingredient ninhydrin or hydrindantin or a mixture thereof.

Burglaries, robberies and other crimes wherein property is stolen frequently go unsolved because of the inherent difficulties in adequately identifying and tracing the stolen goods as well as difficulties inherent in adequately identifying the thief. With respect to identifying stolen goods, the problem is particularly acute where the goods are fungible or otherwise not readily distinguishable from other similar goods. Money is the foremost example of an article that is not readily identifiable or traceable except by recording of serial numbers. Recording of serial numbers is tedious and impractical for most businesses. Consequently, where money is stolen during a burgarly or robbery, the crime is almost never solved by subsequently identifying money found in the possession of a suspect as the money which was stolen. If such a crime is solved at all, it is typically on the basis of subsequent identification of the criminal by personal recognition of eye witnesses or by conventional forensic science techniques such as fingerprint analysis.

Various devices and methods have been proposed in the past for marking a thief or robber during the commission of his crime. For example, the paten to Howatt, U.S. Pat. No. 1,983,461 teaches the use of a dye-squirting device to be concealed in a bundle of money and discharged by a bank teller or clerk as the money is handed over to a robber. This device has not met with any commercial acceptance because it requires the teller to commit an overt, aggressive act that is likely to antagonize the robber.

Another crime detection system disclosed in U.S. Pat. No. 2,909,767 to Zaltman employs dye-spraying devices which are hidden outside a bank entrance and which are actuated during a robbery by bank employees by means of hidden switches inside the bank. The hidden devices spray the bank robbers with dye as they flee the bank and thereby mark them for later identification. This system has proved impractical because of its complexity and unreliability. Furthermore, it does nothing to mark the stolen money for future identification and tracing.

Another theft detection device disclosed in U.S. Pat. No. 3,730,110 to Peters teaches the use of a hidden dye-spraying device inside a cash register. The device is normally deactuated at the beginning of each work day by persons having authorized acess to the cash register and having knowledge of the theft protection system. Unauthorized handling of the cash register or its contents by persons unaware of the device, however, triggers the device and results in permanent staining of the money in the cash register. Although this device may be of some use in deterring a theft, it offers little help in subsequently identifying the thief or the stolen goods because the plainly visible dye on the stolen goods will cause the thief to conceal the money or even discard it to rid himself of the incriminating evidence.

Accordingly, it is an object of the present invention to provide a method for reliably labeling goods at such time as they may be stolen by theft or robbery. It is a further object of this invention to provide a method which chemically labels the goods in a manner imperceptible to the thief and which therefore does not prompt the thief to conceal the goods or prematurely discard or otherwise dispose of them in order to rid himself of the obviously incriminating evidence.

It is also an object of the present invention to provide a method of chemically labeling the person of the criminal during the course of his crime without antagonizing or arousing the suspicions of the criminal. In this regard, it is a further object to provide a method for chemically labeling the criminal in a manner which is not apparent during the course of the crime, but which becomes readily apparent to even a casual observer within a short time after the crime has been committed.

It is yet another object of the present invention to provide a method which similarly labels and identifies the clothing worn by the criminal during the commission of his crime.

SUMMARY OF THE INVENTION

In the method of the present invention, a latent color reagent containing as an active ingredient ninhydrin or hydrindantin or a mixture thereof is kept in or near a cash register or other place where valuables are kept. During a robbery or theft, a small amount of the reagent is discreetly dispensed onto the goods in a manner imperceptible to the thief.

The latent color reagent may be dispensed in various ways. In the simplest method it may be stored in powdered form or in solution in a container and discreetly poured onto valuables in the event of a robbery. The reagent may also be dissolved in a flourocarbon solvent and dispensed as an aerosol from a pressurized spraying device. Automatic dispensing devices may be employed to dispense the reagent upon being triggered by a concealed switch or by an intrusion detection system. The reagent may be employed in an active mode wherein the reagent is caused to be dispensed by a teller or clerk in the event of a robbery. Alternatively, the reagent may be employed in a passive mode whereby it is dispensed automatically onto goods in the event of unauthorized handling of the goods. The latter, or passive, mode is particularly suitable for solving "inside" crimes involving employee thefts and the like.

During the course of the theft and immediately thereafter, the thief handles the goods and thereby unknowingly brings his skin and clothing into contact with the latent color reagent on the surface of the goods. Sometime later, generally approximately twenty minutes after contact with the powdered goods, a deep blue to purple stain develops on the skin of the thief. This stain is relatively indelible and cannot be removed by washing or bleaching for twelve to forty-eight hours. In this manner, the thief is rendered visually conspicuous and readily identifiable by way of the stain on his hands or other portions of his body. He is even further linked circumstantially to his crime by the fact that the stains are visible primarily only during a relatively narrowly defined time span after the crime. The stains render the thief continuously conspicuous from a time shortly after the crime through a two-day period thereafter, a period of time when members of the local public are most likely to be aware of the crime and alert for suspects.

The stolen goods and those portions of the thief's clothing contacted with the latent color reagent do not automatically develop stains as does the skin of the thief. However, the latent color reagent remains intimately adhered to the stolen goods and clothing and can later be chemically developed to quickly produce a prominent color reaction on the surface of the stolen article. A developing solution containing as an active ingredient an organic primary or secondary amine, an amino acid, an ammonium salt or ammonia. Until the developing solution is applied, the latent color reagent is not noticeable, nor can it be washed or dusted off. Ninhydrin, for example, adheres particularly well to clothing and paper goods, such as money, and is merely spread more effectively when dusted or brushed. Washing with a water solution does not remove the ninhydrin and, instead, slowly activates the ninhydrin to produce a colored complex which stains the contacted article upon drying. After application of the developing solution, the resulting colored ninhydrin complex forms an indelible stain on clothing and paper goods which cannot be removed. Thus, the clothing and stolen goods can later be positively identified and traced, yet until the application of the developing solution there are no visible markings or other obserable features that would lead the thief to suspect that the stolen goods or clothing contain such incriminating evidence. The thief thus has no reason to conceal or dispose of the stolen goods, and the likelihood is increased of his openly retaining the stolen goods and eventually giving himself away by passing the goods off through channels where police or other authorities may be monitoring goods for ninhydrin labeling.

DETAILED DESCRIPTION OF THE PREFERRED EMBODIMENT

Ninhydrin is also known alternatively as triketohydrindene hydrate, 2,2-dihydroxy-1,3-indandione or Ruhemann's reagent. It is an analytical reagent which has been used in laboratories for over fifty years for the detection of free amino acids. Free amino acids, as well as certain other nitrogen compounds, react slowly with ninhydrin to produce within a few minutes various brightly colored ninhydrin derivatives which have a blue or purple color. The name Ruhemann's Purple has been traditionally used to designate the colored reaction products of ninhydrin. The reaction is traditionally used for the colorimetric quantitative and qualitative determination of free amino acids. At room temperature, ninhydrin is a pale yellow, slightly hygroscopic crystalline powder and is stable indefinitely. Upon contact with human skin, ninhydrin reacts with free amino acids in the skin to slowly form colored reaction products and cause a deep blue to purple stain in the skin within a time period of five minutes to several hours. With respect to human skin, ninhydrin is thus a latent color reagent with a delayed reactivity. The skin is prominently visible and can be accentuated under ultraviolet light. The stain remains visible on the skin for twelve to forty-eight hours and cannot be washed off or bleached out during this period. Less than one milligram of ninhydrin will produce a readily visible stain on human skin.

In the field of forensic science, ninhydrin has been used to develop fingerprints on certain surfaces, for example paper, which are not amenable to standard fingerprint developing methods. However, the method of the present invention, whereby ninhydrin is used as a basis for chemically labeling goods at the time they are stolen and thereafter detecting and identifying both the goods and the thief, is novel and altogether distinct from the prior art use of ninhydrin.

Hydrindantin is a chemically reduced dimer of ninhydrin that reacts with amino acids and other nitrogen compounds to produce colored reaction products similar to those of ninhydrin. Hydrindantin is more soluble in oils and other nonpolar solvents than ninhydrin and is thereby more readily absorbed in the skin. Hydrindantin is also not hygroscopic and therefore keeps better as a powder than ninhydrin when stored for long periods of time in a container open to the atmosphere. Although hydrindantin may thus be used exclusively as an active latent color reagent in the method of the present invention, it is considerably more expensive than ninhydrin and is therefore preferably used in combination with ninhydrin.

In practice, a powdered mixture having a ratio of approximately five parts by weight ninhydrin to one part hydrindantin is found to provide a satisfactory ratio of these active ingredients. Alternatively, the ninhydrin and hydrindantin may be dissolved in any suitable solvent, for example methanol, preferably at concentrations less than twenty percent by weight. The dissolved ninhydrin and hydrindantin may be dispensed as a solution or as an aerosol.

Since the active ingredients ninhydrin and hydrindantin are each somewhat hygroscopic, a powdered mixture containing the active ingredients will typically include an inert carrier powder which serves as a dessicant and anticaking agent. Although such a carrier is not essential to the function of the ninhydrin or hydrindantin, caking of the powdered active ingredients in their pure form by absorption of water vapor from the atmosphere is thereby avoided. Also, since only a trace amount of ninhydrin or hydrindantin is required to label an article or a person, addition of a carrier powder in concentrations up to sixty percent by weight does not significantly impair the efficacy of the active ingredients.

The inert carrier powder may also serve as a chemical batch tracing agent for subsequently identifying the source of a latent color reagent on a powdered article and for distinguishing the article from similar articles labeled with latent color reagents from other sources. This may be done by varying the composition of the inert carrier powder from one batch to another or by adding a chemically distinct tracing agent to each batch of carrier powder.

In the preferred embodiment of the method, a powdered mixture containing as active ingredients the compounds ninhydrin and hydrindantin is prepared. An inert carrier and drying agent, for example sodium bicarbonate, constitutes a portion of the powdered mixture. A small amount, for example 0.5 grams of the powdered mixture is kept in a vial or other dispensing device within or near a cash register or other place where valuables are kept. During the course of a robbery, the vial or dispenser may be discreetly spilled or opened such that the powdered mixture is dispensed onto the currency or other goods. This may be done manually by a teller or clerk, or it may be done by a dispensing mechanism triggered by a hidden switch. Because of the small amount of powder necessary, typically ten milligrams for a piece of paper the size of a dollar bill, the powder can be dispensed onto the goods and quickly dispersed without arousing the suspicion of the thief. The goods are thus intimately contacted with the powder, and subsequent handling of the goods brings the powder into contact with the hands of the thief. Within approximately ten minutes after handling the goods, a stain begins to develop on the hands of the thief. The stain is fully developed within about forty-five minutes, at which time it has a deep purplish color on the skin. The stain is indelible and lasts for twelve to forty-eight hours, a period during which members of the public are most likely to be aware of the crime and alert for suspects. The thief is thus conspicuously marked and is further linked with the time of his particular crime by the relatively narrow span of time during which the skin is stained. Furthermore, passing of the chemically labeled money to other persons will also cause stains to develop on their hands and thereby alert them to the crime and possibly enable them to identify the thief as the person who passed them the stolen goods. The thief thus may unknowingly leave a trail of stained hands among the people with whom he deals.

The ninhydrin may also be dispensed in a passive method, wherein the ninhydrin is kept among valuable goods in such a fashion that a thief unfamiliar with the security measure will inadvertently spill the ninhydrin or trigger an automatic dispensing device as he removes the goods from their place. Persons authorized to have access to the goods would be knowledgeable of the ninhydrin and how it is dispensed and would thus act accordingly to avoid labelling the goods when handling them. With this technique, the ninhydrin is dispensed onto the goods whenever there is any unauthorized handling of the goods, and is thereby particularly effective in exposing "inside" crimes by employees and other persons entrusted with access to the goods.

In another embodiment of the present invention, a latent odor reagent is also employed as a second active ingredient in a mixture containing ninhydrin or hydrindantin. Such a reagent, for example hydrocinnamic acid, is generally undetectable in an isolated (crystalline) powdered form. However, when it is brought into contact with human skin, it reacts slowly with oils in the skin to produce a pungent, somewhat offensive odor which is readily detectable by persons nearby and is readily amenable to detection by trained dogs. The odor may be particularly useful in labeling a thief because the odor frequently is not noticeable to the person "wearing" it, and a thief so labeled with hydrocinnamic acid may be completely unaware of the conspicuous odor surrounding him. The latent odor reagent thus serves to mark and identify the thief. Hydrocinnamic acid is an aromatic organic compound that is safe to handle and is relatively harmless. When brought into contact with skin, the reagent cannot be readily washed off and exudes an odor for over twenty-four hours. It is effective when employed at a concentration of approximately ten percent by weight in a mixture of ninhydrin, hydrindantin and an inert carrier.

Subsequent identification of the stolen goods and other nonproteinaceous articles brought into contact with the latent color reagent, such as the thief's clothing, is accomplished by use of a developing solution. The developing solution contains a small amount of a nitrogen compound which reacts with ninhydrin and hydrindantin to produce a colored reaction product. A number of nitrogen compounds react with ninhydrin and hydrindantin to produce highly colored reaction products, including ammonia, ammonium salts, amino acids, and most organic primary and secondary amines. Any suitable solvent may be used to dissolve the nitrogen compound, volatile solvents being preferred for faster drying. The concentration of the nitrogen compound in the solution can be quite low, with effective concentrations being approximately 0.2 to 1.0 weight percent. In the preferred method, the developing solution consists of a methanol solution of alanine and ammonium acetate present in equal concentrations of approximately 0.3 weight percent. In its simplest application, the solution may be used by simply applying it to the surface of the article under suspicion. The appearance of a blue to purple color upon drying indicates the presence of ninhydrin or hydrindantin on the article. In the preferred method of application, the solution is used by first dispensing a few drops onto a paper towel and wiping the surface of the suspected article with the wetted towel. In doing so, a portion of the latent color and odor reagents are wiped off of the article and concentrated onto the paper towel where they develop an intense color and a subtle odor. The formation of the colored reaction products can be accelerated by gentle heating.

The color of the ninhydrin or hydrindantin stain may be accentuated by exposure to ultraviolet light. Under ultraviolet light the colored reaction products appear as a jet black stain which is readily observable.

To demonstrate the utility of the present invention, a test was conducted. Several grams of a detector powder consisting essentially of five parts by weight ninhydrin, one part hydrindantin, three parts hydrocinnamic acid, and one part sodium bicarbonate as an inert carrier were prepared. Approximately fifty milligrams of the powdered mixture were sprinkled on one side of a dollar bill, which was thereafter handled by a test person in a routine manner. Within ten to forty-five minutes a prominent dark blue to purple stain developed on the hands of the test person and an offensive odor exuded from the test person. No change was observable in the appearance of the dollar bill during this time. The stains remained prominently visible on the hands of the test person for about two days, during which time the offensive odor gradually subsided.

The dollar bill was subsequently made visually identifiable with a developing solution consisting essentially of a methanol solution of the amino acid alanine and ammonium acetate in equal concentrations of approximately 0.30 weight percent. A portion of a white paper towel was wetted with half a milliliter of the developing solution and then wiped across the surface of the dollar bill. Over a period of five to thirty minutes, deep blue to purple to stains appeared over areas of several square inches on both the dollar bill and the paper towel. A second, clean paper towel was also wiped across the dollar bill immediately after the first paper towel, and it also developed a deep stain. The stains on the dollar bill could not be removed by washing with soap and water.

It will be seen that the method of the present invention offers significant crime deterrent and detection possibilities that have not been heretofore available. By this method a thief and his stolen goods may be discreetly labelled in an imperceptible yet identifiable manner, without danger of antagonizing him or arousing his suspicions.

The embodiments of the invention in which an exclusive property or privilege is claimed are defined as follows:

1. A method of chemically labeling an article with an imperceptible latent color reagent whereby said article may be subsequently distinquished from similar articles not so labeled comprising contacting at least a portion of said article with an effective amount of a material selected from the group consisting of ninhydrin and hydrindantin and mixtures thereof.

2. A method of identifying an article at least a portion of which has been contacted with an effective amount of a first material selected from the group consisting of ninhydrin and hydrindantin and mixtures thereof comprising contacting said article with a second material selected from the group consisting of amino acids, ammonia, ammonium salts and primary and secondary organic amines and mixtures thereof, thereby causing a colored reaction product to be formed on the portion of said article having been contacted with said first material.

3. The method of claim 2 wherein said second material is a mixture of alanine and ammonium acetate.

4. A method of chemically labeling an article with an imperceptible latent color reagent and subsequently identifying said article from other articles not so labeled comprising:

first contacting at least a portion of said article with an effective amount of a first material selected from the group consisting of ninhydrin and hydrindantin and mixtures thereof, thereby labeling said article; and, subsequently contacting said article with an effective amount of a second material selected from the group consisting of amino acids, ammonia, ammonium salts and primary and secondary organic amines and mixtures thereof, thereby causing a colored reaction product to form on the portion of said article first contacted with said material.

5. The method of claim 4 wherein said second material is a mixture of alanine and ammonium acetate.

6. A method of identifying a stolen article comprising:

contacting at least a portion of said article prior to its theft with an effective amount of a first material selected from the group consisting of ninhydrin and hydrindantin and mixtures thereof, thereby chemically labeling said article with an imperceptible amount of a latent color reagent; and, contacting said article with an effective amount of a second material selected from the group consisting of amino acids, ammonia, ammonium salts and primary and secondary organic amines and mixtures thereof after the theft of said article, thereby causing a colored reaction product to form on the surface of the portion of said article contacted with said first material.

7. The method of claim 6 wherein said second material is a mixture of alanine and ammonium acetate.

8. The methods of claims 4 or 6 wherein said first material further includes a chemical batch tracing agent for distinguishing articles labeled with different batches of said first material.

9. A method of chemically labeling a person comprising contacting the skin of said person with an effective amount of a latent color reagent selected from the group consisting of ninhydrin and hydrindantin and mixtures thereof.

10. A method of chemically labeling a person comprising:

first contacting at least a portion of an article with an effective amount of a latent color reagent selected from the group consisting of ninhydrin and hydrindantin and mixtures thereof; and, subsequently causing said article to come into contact with the skin of said person, thereby causing a colored reaction product to be formed on the skin of said person.

11. A method of chemically labeling a thief of an article comprising first contacting at least a portion of said article prior to its theft with a latent color reagent selected from the group consisting of ninhydrin and hydrindantin and mixtures thereof, thereby causing a colored reaction product to be formed on the skin of the thief upon handling said article after its theft.

12. The methods of claims 9, 10 or 11 wherein said latent color reagent further includes an effective amount of a latent odor reagent.

13. The method of claim 12 wherein said latent odor reagent is hydrocinnamic acid.

* * * * *